US005915370A

United States Patent [19]

Casper

[11] Patent Number: 5,915,370

[45] Date of Patent: Jun. 29, 1999

[54] SAW FOR SEGMENTING A SEMICONDUCTOR WAFER

[75] Inventor: Stephen L. Casper, Boise, Id.

[73] Assignee: Micron Technology, Inc., Boise, Id.

[21] Appl. No.: 08/960,721

[22] Filed: Oct. 30, 1997

Related U.S. Application Data

[62] Division of application No. 08/614,711, Mar. 13, 1996, abandoned.

[51] Int. Cl.[6] ..... B28D 1/04

[52] U.S. Cl. ..... 125/13.01; 125/23.02; 83/578

[58] Field of Search ..... 125/13.01, 23.02, 125/23; 451/523, 524, 548; 83/578, 886, 884, 300, 317; 225/97, 96

[56] References Cited

U.S. PATENT DOCUMENTS

| | | | |
|---|---|---|---|
| 3,108,349 | 10/1963 | Takacs | 83/578 |
| 3,809,050 | 5/1974 | Chough et al. | 125/35 |
| 3,811,182 | 5/1974 | Ryan, Sr. et al. | 29/574 |
| 3,976,288 | 8/1976 | Cuomo, Jr. | 269/21 |
| 4,138,304 | 2/1979 | Gantley | 156/268 |
| 4,150,912 | 4/1979 | Gutsche et al. . | |
| 4,184,292 | 1/1980 | DeFazio et al. | 51/235 |
| 4,201,104 | 5/1980 | Insolio | 83/578 |
| 4,213,698 | 7/1980 | Firtion et al. | 355/77 |
| 4,490,441 | 12/1984 | Nohava et al. . | |
| 4,495,732 | 1/1985 | Turner | 51/91 R |
| 4,822,755 | 4/1989 | Hawkins et al. . | |
| 4,834,062 | 5/1989 | Frank et al. . | |
| 5,029,418 | 7/1991 | Bull | 51/281 R |
| 5,527,744 | 6/1996 | Mignardi et al. | 437/266 |
| 5,605,489 | 2/1997 | Gale et al. | 451/28 |
| 5,722,156 | 3/1998 | Balfrey et al. | 29/603.08 |

FOREIGN PATENT DOCUMENTS

| | | | |
|---|---|---|---|
| 212244 | 1/1958 | Australia | 125/23.02 |
| 946897 | 6/1949 | France | 125/23.02 |
| 1175303 | 3/1959 | France | 125/23.02 |
| 334403 | 3/1921 | Germany | 125/23.02 |

*Primary Examiner*—David A. Scherbel
*Assistant Examiner*—Derris H. Banks

[57] ABSTRACT

An apparatus for cutting a semiconductor wafer comprises a wafer holding assembly and a cutting assembly having at least one cutting element. The apparatus further comprises a control assembly coupled to the cutting assembly which is operable to move the cutting assembly in first and second generally opposed directions relative to a wafer held by the wafer holding assembly. The cutting assembly is further operable to engage the wafer as the cutting assembly is moved in both the first and second directions. A method of segmenting a semiconductor wafer comprises the steps of providing a reciprocating cutting assembly, the cutting assembly including at least one cutting element and reciprocates in first and second generally opposed directions. The cutting assembly engages the wafer as the cutting assembly moves in the first direction and as the cutting assembly moves in the second direction.

11 Claims, 3 Drawing Sheets

SAW FOR SEGMENTING A SEMICONDUCTOR WAFER

This application is a continuation of application Ser. No. 08/614,711, filed Mar. 13, 1996 now abandoned.

FIELD OF THE INVENTION

This invention relates to the field of semiconductor manufacture, and more particularly to a method and apparatus for slicing a semiconductor material such as a semiconductor wafer.

BACKGROUND OF THE INVENTION

During the manufacture of a semiconductor device, a plurality of die are typically formed within and on a wafer of semiconductor material. After the plurality of die are formed the wafer is sliced to segment the plurality of die using a die saw. To slice the wafer it is attached to a metal frame by an adhesive film. A mount on the die saw receives the frame and wafer, and a blade of the die saw moves back and forth across the wafer. The blade begins at a first position, and contacts and cuts the wafer as it travels across the wafer in one direction. After the blade completes the cut across the wafer, the blade is removed from wafer contact and is returned to the first position, and another pass across the wafer is begun. Thus the blade cuts the wafer during the first pass across the wafer, but does not cut the wafer as it returns to the starting position.

Maximizing throughput during any step of a semiconductor manufacturing process is desirable due to the high volume of parts moving through a semiconductor fabrication facility. A method and apparatus which allows for increased throughput through the wafer slicing step would decrease costs, increase production, and would therefore be desirable.

SUMMARY OF THE INVENTION

An apparatus for cutting a semiconductor wafer comprises a wafer holding assembly and a cutting assembly having at least one cutting element. The apparatus further comprises a control assembly coupled to the cutting assembly, the control assembly operable to move the cutting assembly in first and second generally opposed directions relative to a wafer held by the wafer holding assembly. The cutting assembly is operable to engage the wafer as the cutting assembly is moved in both the first and second directions.

Various objects and advantages will become apparent to those skilled in the art from the following detailed description read in conjunction with the appended claims and the drawings attached hereto.

It should be emphasized that the drawings herein are not to scale but are merely schematic representations and are not intended to portray the specific parameters or the structural details of the invention, which can be determined by one of skill in the art by examination of the information herein.

DETAILED DESCRIPTION OF PREFERRED EMBODIMENTS

Figure 1A:
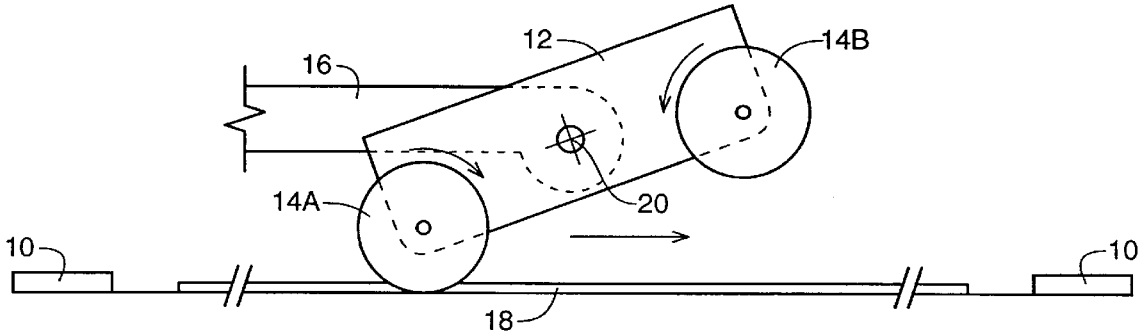
FIGS. 1A and 1B schematically depict an exemplary apparatus in accordance with the present invention illustrated from a side view.

One embodiment of an apparatus for cutting a semiconductor wafer, as shown in FIG. 1A, comprises a wafer holding assembly 10, a cutting assembly 12 having at least one cutting element 14A, 14B, and a control assembly 16 coupled to the cutting assembly 12. The cutting element can comprise a generally circular blade as is used with conventional technology, or the cutting element could comprise a continuous band which slices the wafer. The control assembly is operable to move the cutting assembly in first and second generally opposed directions relative to a wafer 18 held by the wafer holding assembly. The cutting assembly is further operable to engage the wafer as the cutting assembly is moved in both the first and second directions.

Figure 1B:
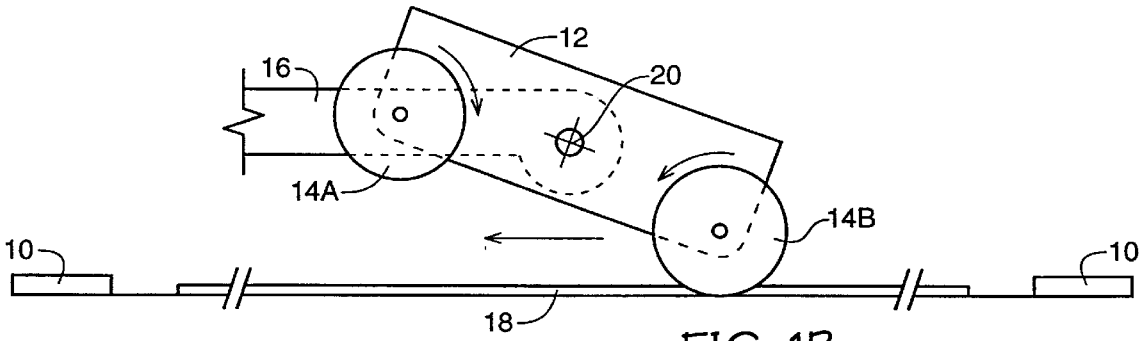

The cutting assembly of FIG. 1A comprises two cutting elements 14A, 14B such as generally circular blades rotating in opposite directions. The cutting assembly of FIG. 1A is operable such that only the first blade 14A cuts a wafer as the cutting assembly moves in the first direction, and operable such that only the second blade 14B cuts a wafer as the cutting assembly moves in a second direction. The cutting assembly shown in FIG. 1A pivots as shown in FIG. 1B about point 20 to allow the first and second cutting blades to move toward and away from the wafer, depending on the direction of the cut. The cutting assembly is pivoted by any sufficient means, such as by a motor or other control mechanism (not shown) mounted to the cutting assembly.

Figure 2:
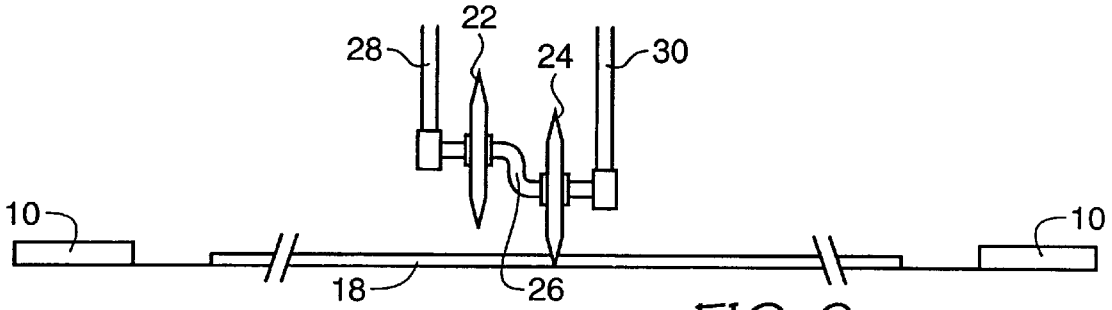
FIG. 2 is a cross section showing a second embodiment of the invention.

FIG. 2 shows a second embodiment having a pair of blades 22, 24 which rotate in opposite directions and are moved toward and away from the wafer using an offset mechanism 26. The blades can be rotated using a belt or gear assembly (not shown) or other drive mechanisms which would be evident to one of skill in the art from the description herein. In the embodiment shown, a pair of arms 28, 30 which are part of a cutting assembly are driven by a controller (not shown) to move the first blade 24 toward the wafer and a second blade 22 away from the wafer. After the cut is completed, blade 24 is moved away from the wafer, and blade 22 is moved toward the wafer. Blade 22 then completes a cut as the cutting assembly moves across the wafer.

Figure 3A:
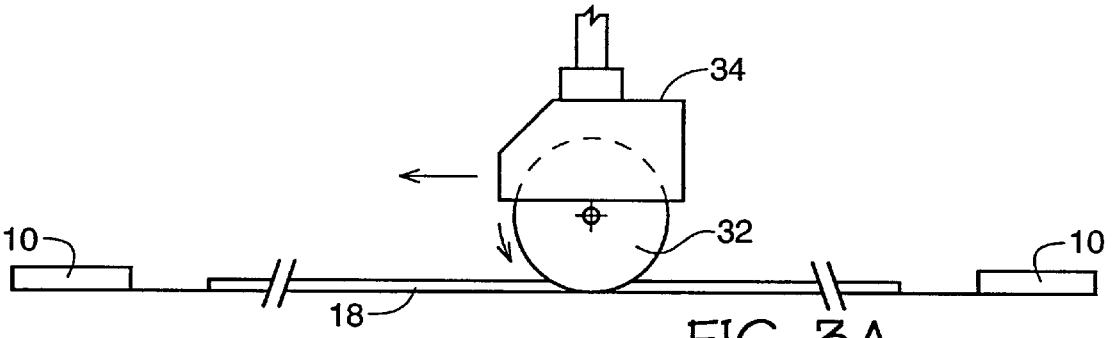
FIGS. 3A and 3B depict a side view of a further embodiment.
Figure 3B:
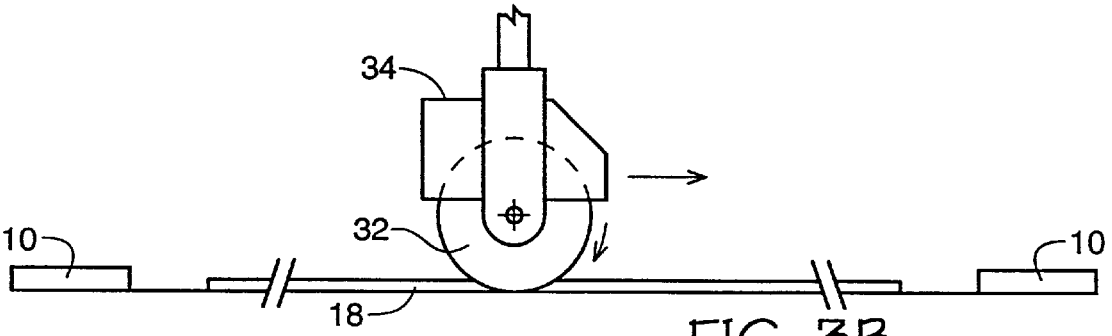

FIGS. 3A and 3B show an embodiment of the invention comprising a single blade 32. As a cutting assembly 34 moves in a first direction as shown in FIG. 3A, the blade rotates counterclockwise to segment the wafer as the blade passes over the wafer 18. After completing a cut, the cutting assembly turns 180° to reverse the rotational direction of the blade 32 with respect to the wafer. The blade, therefore, is not required to actually reverse directions, but the direction is reversed with respect to the wafer. The cutting assembly then moves in a second direction as shown in FIG. 3B, and the blade segments the wafer as the cutting assembly passes over the wafer in a second direction generally opposed to the first direction.

Figure 4:
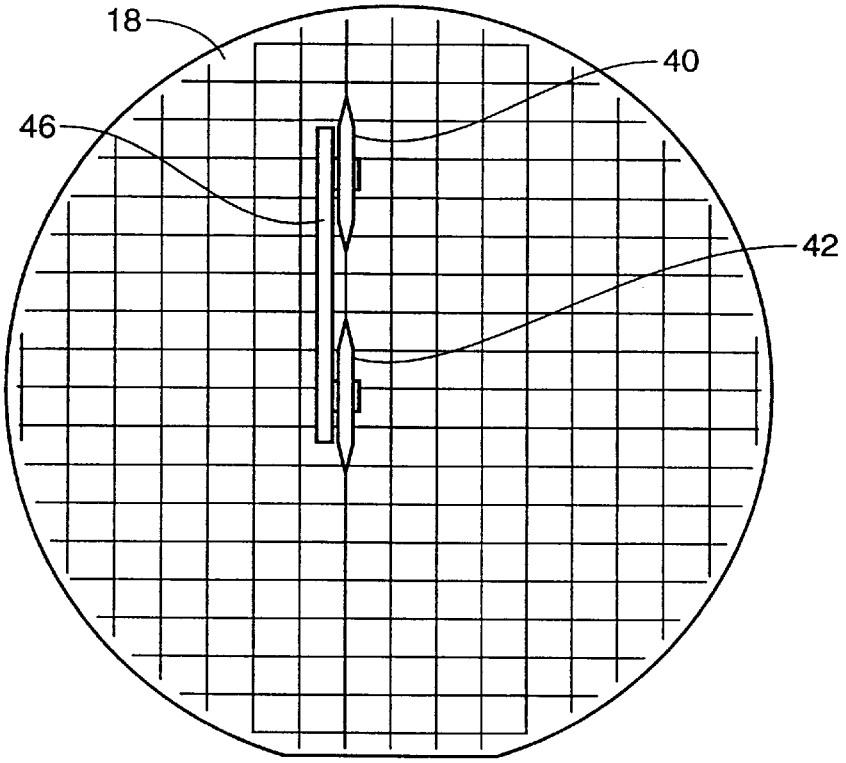
FIGS. 4 and 5 are top views depicting possible blade alignments in first and second embodiments each having two blades.
Figure 5:
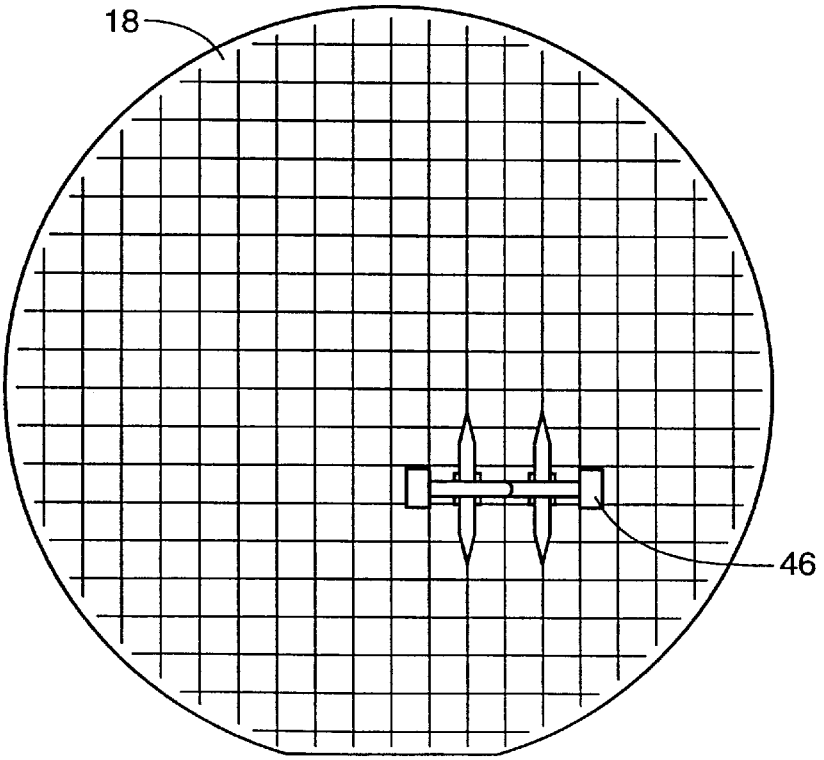

FIGS. 4 and 5 depict the position of the blades relative to each other in first and second embodiments each having two blades. As shown in FIG. 4, the blades can be aligned with each other, or the blades can be offset as shown in FIG. 5. When the blades are aligned as in FIG. 4, the cutting assembly is indexed to a lateral position after each pass over the wafer, that is before making each cut in the first direction, and also before making each cut in the second direction. If the blades are offset as in FIG. 5, and the spacing between the two blades allows for their alignment with area between the die to be cut, indexing the cutting assembly 46 is required after only every other pass across the wafer.

A method of segmenting a semiconductor wafer comprises the steps of providing a reciprocating cutting assembly, the cutting assembly including at least one cutting element. The cutting assembly reciprocates in first and second generally opposed directions. The wafer is engaged with the cutting assembly as the cutting assembly moves in the first direction and as the cutting assembly moves in the second direction. With a one blade assembly, the same blade cuts the wafer as the cutting assembly moves across the wafer in both the first and second directions. In an assembly comprising first and second blades, only the first blade cuts the wafer as the cutting assembly moves across the wafer in the first direction, and only the second blade cuts the wafer as the cutting assembly moves across the wafer in the second direction.

While this invention has been described with reference to illustrative embodiments, this description is not meant to be construed in a limiting sense. Other embodiments of the invention will become apparent to those skilled in the art from reading this description. For example, an apparatus which comprises stationary blades and an assembly which moves the wafer would be possible, as would various other assemblies for moving each blade toward and away from the wafer. Further, cutting surfaces other than blades and continuous bands are possible, and using more than two cutting surfaces is possible. It is therefore contemplated that the appended claims will cover any such modifications or embodiments as fall within the scope of the invention.

I claim:

1. An apparatus for segmenting a semiconductor wafer comprising:

a wafer holding assembly;

a wafer cutting assembly having at least first and second cutting elements operable to segment a wafer held by said wafer holding assembly, said wafer having a diameter; and a control assembly coupled to said cutting assembly, said control assembly operable to engage said wafer with only said first cutting element as said cutting assembly moves across said wafer in a first direction parallel to said diameter and to engage said wafer with only said second cutting element as said cutting assembly moves across said wafer in a second direction parallel with said diameter and generally opposed to said first direction.

2. The apparatus of claim 1 wherein said first cutting element is a first circular blade and said second cutting element is a second circular blade, wherein said first and second blades are rotatable in opposite directions.

3. An apparatus for segmenting a semiconductor wafer comprising:

a wafer holding assembly;

a wafer cutting assembly having at least one rotatable cutting element operable to segment a wafer held by said wafer holding assembly; and a control assembly coupled to said cutting assembly, said control assembly operable to engage said wafer with said cutting element as said cutting assembly moves across said wafer in both first and second generally opposed directions and further operable to reverse a direction of rotation of said cutting element with respect to said wafer.

4. The apparatus of claim 3 wherein said at least one cutting element has a generally planar surface and is operable to rotate 180° about an axis, wherein said axis is generally parallel with said generally planar surface of said cutting element.

5. The apparatus of claim 3 wherein said at least one cutting element is operable to reverse said direction of rotation with respect to said control assembly.

6. The apparatus of claim 3 wherein said cutting assembly comprises only one rotatable cutting element.

7. An apparatus for segmenting a semiconductor wafer comprising:

a wafer holding assembly comprising a frame and an adhesive film, said film having a center portion and a perimeter, wherein said film contacts said frame only at said perimeter;

a wafer cutting assembly having at least one rotatable cutting element operable to segment a wafer held by said wafer holding assembly; and a control assembly operable to engage said wafer with said at least one cutting element as said cutting assembly moves across said wafer in both first and second generally opposed directions.

8. The apparatus of claim 7 further comprising at least first and second rotatable cutting elements wherein only said first cutting element engages said wafer as said cutting assembly moves across said wafer in said first direction and only said second cutting element engages said wafer as said cutting assembly moves across said wafer in said second direction.

9. The apparatus of claim 7 wherein said cutting assembly comprises only one rotatable cutting element adapted to reverse direction of rotation with respect to said wafer.

10. A method of segmenting a semiconductor wafer comprising the following steps:

providing a wafer holding assembly and a wafer held by said wafer holding assembly;

providing a wafer cutting assembly having at least first and second cutting elements operable to move across said wafer and to segment a wafer held by said wafer holding assembly, said wafer having a diameter;

providing a control assembly coupled to said cutting assembly;

engaging said wafer with only said first cutting element as said cutting assembly moves across said wafer in a first direction parallel to said diameter; and engaging said wafer with only said second cutting element as said cutting assembly moves across said wafer in a second direction parallel with said diameter and generally opposed to said first direction.

11. The method of claim 10 wherein said first and second cutting elements are circular blades, further comprising the following steps;

rotating said first blade in a first rotational direction during said step of engaging said wafer with said first blade; and rotating said second blade in a second rotational direction generally opposed to said first rotational direction during said step of engaging said wafer with said second cutting element.

* * * * *